US005415012A

United States Patent [19]

Maier-Laxhuber et al.

[11] Patent Number: 5,415,012

[45] Date of Patent: May 16, 1995

[54] COOLING SYSTEM HAVING A VACUUM TIGHT STEAM OPERATING MANIFOLD

[75] Inventors: Peter Maier-Laxhuber, Unterschleissheim; Reiner Engelhardt; Reiner Wörz; Andreas Becky, all of München, Germany

[73] Assignee: Zeo-Tech GmbH, Unterschleissheim, Germany

[21] Appl. No.: 286,940

[22] Filed: Aug. 8, 1994

Related U.S. Application Data

[63] Continuation of Ser. No. 85,525, Jul. 1, 1993.

[30] Foreign Application Priority Data

Jul. 6, 1992 [EP] European Pat. Off. ..... 92111436

[51] Int. Cl.[6] ..... F25B 19/00

[52] U.S. Cl. ..... 62/269; 62/299

[58] Field of Search ..... 62/268, 269, 100, 480, 62/299

[56] References Cited

U.S. PATENT DOCUMENTS

| | | | |
|---|---|---|---|
| 236,471 | 1/1881 | Windhausen | 62/269 |
| 2,023,444 | 12/1935 | Roe | 62/269 |
| 3,150,497 | 9/1964 | Beckman | 62/100 |
| 4,752,310 | 6/1988 | Maier-Laxhuber et al. | 62/480 |
| 4,881,376 | 11/1989 | Yonezawa et al. | 62/480 |

FOREIGN PATENT DOCUMENTS

| | | | |
|---|---|---|---|
| 5915 | of 1892 | United Kingdom | 62/269 |

*Primary Examiner*—John M. Sollecito
*Attorney, Agent, or Firm*—Hoffmann & Baron

[57] ABSTRACT

A cooling system with a vacuum tight operating system manifold line contains at least two connecting locations on which at least an operating medium evaporator and at least a sorption agent container having sorption medium therein are coupled in an airtight manner to the operating system manifold. The sorption medium container is capable of absorbing and deabsorbing operating medium vapor.

10 Claims, 1 Drawing Sheet

16'
17
13
16
15
14
2
12
3'
3
21
18
19'
20
19
4
1
23
26
25
24
22
5'
5
28
29
27
7
33
31
32
30
6'
6
34
39
38
8
36
37
35
40
41
42
9
44
10
58
11
55
53
54
57
43
45
46
49
47
51
52
50
56
60
48
59

COOLING SYSTEM HAVING A VACUUM TIGHT STEAM OPERATING MANIFOLD

This is a continuation of copending application Ser. No. 0 8/0885,525, filed on Jul. 1, 1993.

BACKGROUND OF THE INVENTION

1 . Field of the Invention

This invention relates to cooling systems, and more particularly to a cooling system having a steam operating manifold on which at least an evaporator and a sorption agent container are connected.

2. Description of the Prior Art

Cooling apparatus and methods in accordance with the sorption principle, for example, German Patent No. DE 3,425,419, wherein a portion of an aqueous liquid is vaporized and adsorbed as steam by a sorption agent, are known. As a result of the evaporation of a portion of liquid from the aqueous solution, the aqueous solution cools while the sorption agent which adsorbs the vapor is heated. The cooling methods according to the sorption principle are primarily conducted in closed systems where a vacuum pressure is provided so as to permit the aqueous solution to evaporate at relatively low temperatures. This type of cooling system is relatively inflexible since the evaporator must always be connected to the cooling device.

German Patent No. DE-OS 4,003,107 relates to an ice maker which operates in accordance with the sorption principle. This patent discloses freezing an aqueous liquid in an icing container/evaporator by means of a solid sorption agent to which a vacuum pump is connected. The ice maker manufactures ice cubes which are used to cool liquid refreshments. This ice maker, like the aforementioned cooling system, is relatively inflexible since the evaporator must always be connected to the cooling device.

OBJECTS AND SUMMARY OF THE INVENTION

It is an object of the present invention to provide a cooling system having a vacuum tight steam operating manifold.

It is another object of the present invention to provide an economically efficient, universally compatible cooling system.

It is a further object of the present invention to provide a universally usable cooling system which overcomes the inherent disadvantages of known cooling systems.

In accordance with one form of the present invention, a cooling system having a vacuum tight steam operating manifold includes at least two connecting locations, to which at least an evaporator and at least a sorption medium container are connected in a vacuum tight manner. Moreover, a vacuum pump may be coupled to the sorption agent container for generating a sufficient vacuum pressure when zeolite is used as the sorption agent and water is used as the operating medium so that the water can evaporate at relatively low temperatures. Preferably, for energy economy, the vacuum pump should only operate when a relatively high pressure condition exists within the system which would inhibit the evaporation of operating medium.

These and other objects, features and advantages of this invention will be apparent from the following detailed description of the illustrative embodiments thereof, which is to be read in connection with the accompanying drawings.

DETAILED DESCRIPTION OF THE PREFERRED EMBODIMENTS

Figure 1:
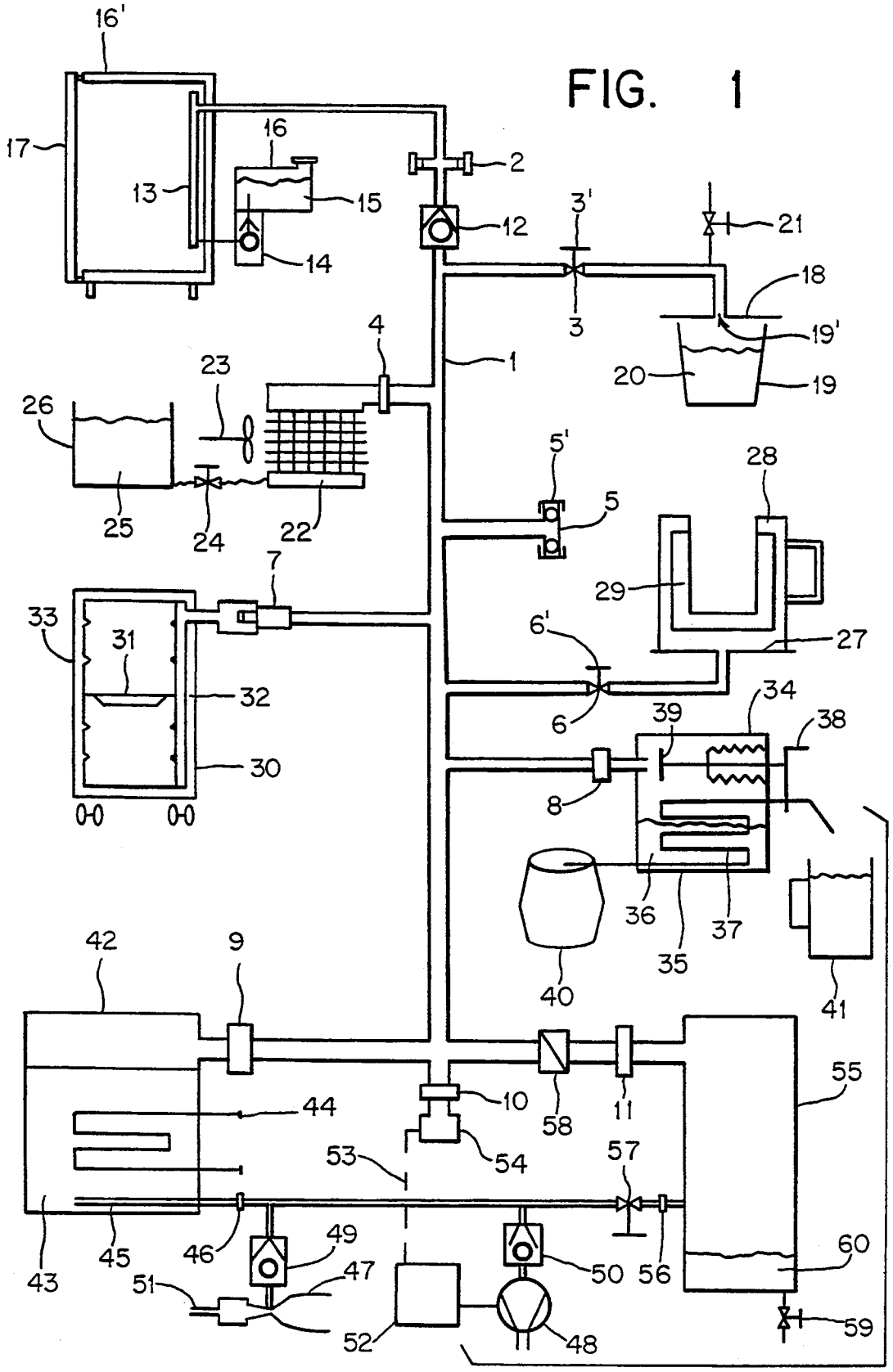
FIG. 1 is a diagram of a cooling system having a vacuum tight steam operating manifold constructed in accordance with the present invention.

Referring now to FIG. 1, a cooling system having a vacuum tight steam operating manifold constructed in accordance with the present invention will now be described. The cooling system includes an operating steam manifold line 1 having a plurality of connecting locations 2, 3, 4, 5, 6, 7, 8, 9, 10 and 11. A check valve 12 is coupled to connection location 2 so as to prevent a flow of operating steam from the manifold into refrigerator/evaporator 13. However, check valve 12 permits a flow of operating steam from the refrigerator-/evaporator 13 into manifold 1. A swimmer valve 14, coupled to the refrigerator/evaporator, permits water 15 stored in supply tank 16 to flow in small quantities into the refrigerator/evaporator from the supply tank when a low water level is detected in the refrigerator-/evaporator. The refrigerator/evaporator 13 is thermally insulated by housing 16' and the interior of the housing is accessible through door 17. The evaporation temperature of the water in the refrigerator/evaporator 13 is defined by the operating steam pressure in manifold line 1. The lower the operating steam pressure in manifold line 1, the lower the evaporator temperature in refrigerator/evaporator 13.

In the preferred embodiment, a ball valve 3' is coupled so as to be in fluid communication with connection location 3. Also coupled to connection location 3 is a flanged plain sealing surface 18. Container 19, having aqueous liquid 20 therein, has an opening 19' which is smaller than the smallest planar dimension of the sealing surface 18. Preferably, the container 19 and opening 19' is coupled to the plain sealing face in an air-tight manner. When the ball valve 3' is opened, the pressure within the container 19 decreases and portions of the aqueous liquid 20 evaporate. This causes a decrease in the temperature of the aqueous liquid and ultimately, after sufficient evaporation, freezing of the liquid. After closing the ball valve and opening a venting valve 21 which is coupled between connecting location 3 and flanged plain sealing surface 18, the vacuum pressure in container 19 is eliminated. Therefore, container 19 having the frozen aqueous liquid therein can be separated from the system. It is particularly advantageous if container 19 includes thermal insulation (not shown), around extremities of the container to reduce the unintentional transfer of heat from the ambient air so as to extend the time that the aqueous liquid remains frozen. The time for freezing the aqueous liquid is dependent on the volume of frozen liquid generated and the characteristics or properties of the aqueous liquid which is to be solidified.

Connecting location 4 of manifold 1 preferably has air cooler 22 coupled in fluid communication thereto, so that cool air can be transported from blower 23. A thermostat 24 permits aqueous liquid 25 to be provided out of aqueous liquid supply container 26 into air cooler 22. After the aqueous liquid enters air cooler 22, an amount of the liquid evaporates causing the remaining portion of liquid therein to cool and freeze. As blower 23 forces air over air cooler 22, the air flow is cooled.

In the preferred embodiment, connecting location 5 is closed by a blind plug 5' which may be removed when required so that connecting location 5 may be attached to any given cooling/evaporator. Blind plug 5' provides an air-tight closure of connecting location 5 in order to maintain the internal pressure of manifold 1.

Preferably, connection location 6 has a ball valve 6', similar to that attached at connecting location 3, coupled thereto. In addition, a plain sealing surface 27 having an opening therethrough is connected to the ball valve. The opening of plain sealing surface 27 is in fluid communication with connecting location 6 and is positioned so that double wall containers 28, which contain a hydrophilic medium 29 (for example, a sponge) inside a jacket space can be air tight mounted thereon. The hydrophilic medium 29 preferably contains an aqueous liquid such as water. By opening the ball valve 6', a portion of the aqueous liquid evaporates from the hydrophilic medium 29. The evaporation of the aqueous liquid cools the aqueous solution still absorbed by the hydrophilic medium 29 which causes an ice buffer to form. The double wall container 28 can be removed by closing the ball valve 6' and venting the system in a manner similar to that described with regard to connection location 3.

Connecting location 7 preferably consists of a two-sided closing coupler. The connecting location may be connected to a movable transport cart 30 (trolley) which may be used for storing perishable food and drinks during transport. The transport cart includes an evaporator 32 located inside cart 30 which provides cooling. Preferably, the cart is provided with inner guide bars on which trays 31 may be mounted during transport and storage. The cart may be loaded with prepared meals and other food in the catering station. In addition, a water supply may be provided to the evaporator 32 in the catering station which will be frozen by direct evaporation when connected to a sorption medium container. Preferably, the evaporator 32 is coupled from sorption medium container at the catering station so as to provide an ice-buffer. This ice build-up bridges long waiting times from the point when the food is placed in the cart at the catering station until the cart is attached to an onboard operating steam manifold line. The cart, which is preferably insulated on its outer surfaces by an insulation layer 33, may be connected in an airplane-galley to an on-board operating steam manifold line contained on the airplane to maintain cooling during the trip.

Preferably, connecting line 8 is coupled so as to be in fluid communication with a drink cooling system 34. The drink cooling system consists of an evaporator container 35 having a steel cooling coil 37 surrounded by a supply of aqueous liquid 36. A control tap 38 manipulates valve 39 which permits or prevents communication with the manifold 1. When tap 38 is opened, valve 39 is also opened so that evaporated aqueous liquid can flow into the operating steam manifold line 1, thus cooling the remaining amount of aqueous liquid. This in turn cools cooling coil 37 which is surrounded by the aqueous liquid. Tap 38 also controls a flow of liquid from container 40 through the cooling coils 37 to container 41. After a relatively short time period, the aqueous liquid 36 and cooling coils 37 are cooled to such an extent that when tap 38 is completely open, the liquid that is stored in container 40 may flow through the cooling coil 37 into container 41 while having its temperature reduced in the cooling coil. By closing the tap 38, valve 39 is also closed. As a result, the cooling capacity of the system is not utilized and lost when the drink cooling system is not in use. Preferably, the container 40 can be stored at room temperature without any loss of cooling capacity.

In the preferred embodiment, connecting location 9 is in fluid communication with a sorption medium container 42 that contains sorption medium 43 therein. A suitable sorption medium is zeolite. An electric heater 44 is preferably included and extends through a portion of the sorption medium in order to regenerate the sorption medium 43. In the lower region of the zeolite filler 43 contained in sorption medium container 42, preferably at a location distal with respect to connecting location 9, a vacuum line 45 having connecting location 46 is coupled so as to be in fluid communication with vacuum pumps 47, 48. Each vacuum pump 47, 48 is coupled to vacuum line 45 through respective check valves 49, 50. The vacuum pump 47 may be a compressed air ejector. As soon as compressed air flows through feed line 51, a vacuum pressure is generated by the Venturi-effect, which evacuates the total cooling system through vacuum line 45 and sorption medium 43.

A suitable vacuum pump 48 is an alternatively switchable mechanical vacuum pump. Vacuum pump 48 may be driven by an electromotor 52 which, preferably only operates if a high pressure signal is detected by pressure sensor 54 and provided through signal line 53. The pressure sensor 54 is coupled through connecting location 10 to the operating steam manifold line 1.

In the preferred embodiment, condenser 55 is coupled to connecting location 11. The condenser liquifies the evaporated aqueous liquid received from the operating steam manifold 1 by utilizing a cold face. In the alternative, the evaporated liquid precipitates in form of frozen fog. The evaporation temperature in each of the above-described evaporators must be higher than the temperature of the cold face in the condenser. Any gases hindering the free flow of evaporated liquid may be removed through connecting location 56 and a shut-off valve 57 coupled to vacuum pumps 47 and 48. A check valve 58 prevents a return flow of evaporated liquid into the operating steam manifold 1 if the temperature within the condenser substantially increases causing evaporation of the condensed evaporated liquid. The condensed evaporated liquid 60 collects at the bottom of the condenser 55 and, if needed, may be removed through a discharge valve 59. It is particularly advantageous if the condensed liquid is fed back into supply containers 26 and 16 with return feed lines. In airplanes, the cold faces may reach a desirable temperature as a result of exposure to the ambient air surrounding the airplane.

As stated above, the cooling system basically consists of a vacuum tight steam operating manifold 1 which has a plurality of connecting locations, to which at least an operating medium evaporator and at least a sorption medium container are connected in a vacuum tight manner. Moreover, a vacuum pump is included for generating a sufficient vacuum pressure when using zeolite as the sorption agent and water as the operating medium, so that water can evaporate at relatively low temperatures. For economy, the vacuum pump should only go into operation when the pressure conditions in the system require it and not when these conditions are not present.

Suitable vacuum pumps are known for this purpose. However, it may be particularly advantageous to use vacuum pumps which do not require lubrication, so called dry running vacuum pumps. An end pressure of 8 hPa can be realized with a two step dry running vacuum pump. If a lower end pressure is required, a three step pump may be used.

Recently vacuum ejectors, commonly referred to as Venturi-jets, have been utilized more frequently because they are only driven by compressed air. The Venturi-jets, which customarily operate in a multi-stage manner, can generate end pressures of8 hPa by means of a compressed air supply of 5 to 6 bar. Compressed air systems are present in many commercial vehicles including large trucks, railroad cars, and airplanes. Since the vacuum pumps are relatively inexpensive and have a relatively low air consumption, a cooling system employing a Venturi-jet is particularly economical. In addition, since the ambient air pressure at high altitudes is between 200 and 300 hPa, the compressed air driven vacuum ejectors are more economical and efficient when used in these environments.

Cooling systems which are installed in passenger cars can benefit from the vacuum devices customarily installed in these vehicles. Since many vehicle systems, such as central locking, braking and steering require a vacuum for proper operation, it is advantageous to replace the standard vacuum pump with a pump having a lower end pressure. The initial additional expense is relatively low since neither a new motor nor a substantially more expensive and complex control is required. Moreover, any additional weight associated with the new vacuum pump remains within acceptable weight limits and restrictions since only a further vacuum stage has to be integrated to the existing vacuum pump.

The vacuum pumps 47, 48 are designed to evacuate the sorption medium container 42 and corresponding connecting line, the steam operating manifold 1, as well as each of the connected operating medium evaporators. It is advantageous to include a device between the sorption medium container and the vacuum pump which prevents a reverse flow of air into the cooling system when the vacuum pump is idle. Such a reverse flow of air could impair the operating medium adsorption capacity of the sorption agent. Simple check valves are suitable for this purpose. However mechanically or electrically actuated valves are also suitable.

The sorption medium container itself may have a variety of designs. However, the container must be constructed so that the operating medium steam which flows into the sorption medium container can reach all regions of the sorption medium within the container. It is therefore preferred to remove substantially all of the air and noncondensable gases from the sorption medium filler. The subsequent inflow of operating medium vapor should not be removed when vacuuming off the air and non-condensable gases from the sorption medium container. It is therefore preferred to configure the sorption medium container so that the input opening of the operating medium steamline manifold is located at one end of the container and the vacuum pump connecting line is located at an opposite end of the sorption medium container.

Furthermore, it is also advantageous to configure the connecting locations on the sorption container with easy or quickly releasable connections. Therefore, a container having saturated sorption medium can be easily replaced with a new container having unsaturated sorption agent.

Customarily, sorption medium containers having substantially saturated sorption medium can be regenerated by heating the sorption medium. When heat is applied, the operating medium is driven out of the sorption agent as vapor. This regeneration can be performed at any given time and any given location. It is even possible to use exhaust from an internal combustion engine or an electric heater to expel the operating medium from the sorption medium. Depending on the regeneration method utilized, the sorption medium container may be adapted to the specific regeneration process by installing an electric heater or by including heat exchanger outer walls which can transfer heat to the sorption medium through the container walls. Furthermore, reaction heat, which is released during the sorption of operating medium vapor by the sorption medium filler, can also be stored for later use in regenerating the sorption medium. Naturally, the heat generated as a result of the sorption action may be stored and transferred for any heating use.

As implied above, regeneration of the sorption medium filler may be realized without separating the sorption medium container from the operating steam manifold. However, when regenerating the sorption medium filler, the operating medium steam should be prevented from returning to the operating steam manifold. This is accomplished by including simple check valves at each connecting location. Mechanically or electrically actuated shut-off fittings can also be used. If it is desired to reliquify the operating medium steam that was expelled from the sorption medium filler, it may be returned to the evaporators through separate return feed lines.

Absorption and adsorption substances are commonly referred to as sorption agents and are well known in the cooling technology. It had been shown that the use of molecular screens or zeolites as sorption agents is particularly advantageous. Zeolites adsorb up to 30percent by weight of water and release the same to the environment as vapor at temperatures of up to 300° C. Hence, in the preferred embodiment, the operating agent is water which is vaporized in each evaporator and which flows in the form of steam through the operating steam manifold into the sorption medium container. Since the vapor pressure of water is relatively low, the vacuum pump must reach a minimum pressure of 6.1 hPa in order to enable evaporation temperatures of approximately 0° C. With a pressure of 6.1 hPa, the water in the operating medium evaporator can completely freeze. It is possible, by making a larger supply of ice, to cool the evaporation device an additional amount even after it has been disconnected from the operating steam manifold. However, the operating medium vapor can only flow through the manifold and be adsorbed by the zeolite filler if the vacuum pump generates a sufficiently low pressure in the system.

A variety of vacuum tight lines are suitable for use as the operating steam manifold. Since the operating medium vapor customarily has relatively low temperatures, flexible plastic lines may be used. Principally, a variety of known fittings may be used at the connecting locations. In the preferred embodiment, each connecting location that is not coupled to an evaporator is sealed in a vacuum-tight manner. This may be accomplished by utilizing self-closing rapid couplings in order to maintain the vacuum pressure within the system.

If the evaporator and sorption medium container are easily connected and unconnected, they can be readily installed at any corresponding chosen location on the operating steam manifold. The operating steam manifold is designed to connect a plurality of evaporators with a single sorption medium container, a single evaporator with a plurality of sorption agent containers or any combination there between. Naturally, the connecting locations, through which only relatively small volumes of steam can be withdrawn, may be combined with connecting lines having correspondingly small cross sections. In this manner, an operating steam manifold having many branches may be utilized for only a single sorption agent container having only a single vacuum pump.

The term "evaporator" denotes all devices for use in this invention wherein an operating medium liquid evaporates. The evaporated liquid then flows in the form of steam or vapor into the operating steam manifold. Therefore, all suitable components or systems known in the cooling technology will be considered as evaporators, in particular, the evaporator plate of a refrigerator, the evaporation line of a drink cooler and the evaporation air cooler of an air conditioning unit.

The flow cross-section and general construction of each evaporator is determined by the operating medium utilized. When water is used as the operating medium, the evaporator may be constructed in accordance with the German laid open publications DE-OS 4,003,107 and DE-0S 4,138,114 . Since a plurality of evaporator construction types may be connected to the same operating steam manifold line, and the evaporation temperatures may be controllable at a variety of different temperatures, it is advantageous if a steam gauge or valve is installed either in each evaporator unit or at each connecting location. This controls the volume of steam flow to such an extent that a higher evaporation temperature is realized on the manifold line. The operating steam pressure in the manifold defines the lowest possible evaporation temperature in each of the connected evaporators.

The vacuum pump utilized in the present invention could operate constantly in order to maintain the vacuum pressure required for vaporizing the operating medium. However, if the cooling system is sufficiently air-tight, the vacuum pump need only periodically remove the non-condensable gases from the sorption medium in order to make the sorption filler readily accessible for the operating medium vapor. Additionally, for energy conservation considerations, it is preferred that the vacuum pump only operate if an additional evaporator is connected or when connecting ice making devices which require a temporary low evaporation temperature.

It may also be economically advantageous to limit operation of the vacuum pump to situations in which it is absolutely necessary. Thus, it will be realized that the cooling system must be evacuated only a few seconds per day. In order to operate the vacuum pump in this manner, a plurality of possibilities are available. An increasing evaporation temperature in the evaporator can close an installed thermostat and thereby activate the vacuum pump. Since it customarily takes time until the evaporation temperature has dropped to such an extent that the thermostat is again closed, it is logical to equip the vacuum pump with a timer that deactivates the pump after a few seconds even though the thermostat is still closed.

A further possibility is to activate the vacuum pump by push switches. The activation pressure of the push switch can be easily adjusted to turn the vacuum pump on and then off when the pressure reaches an acceptable level. However, it is also advantageous to provide the connecting locations of the manifold line with a contact switch which operates the vacuum pump for a predetermined time period when an evaporator is initially connected.

It is particularly advantageous if the cooling system is equipped with a so-called cold face. This cold face enables a system using water as the operating medium to liquify operating medium vapor or to condense it at temperatures below 0° C. However, this is only logical if the cold face has a lower temperature level than the lowest evaporation temperature in all of the evaporators. For example, when using the cooling system in a household during the winter months, operating steam which is generated in the evaporator can be condensed on the cold face which is cooled by the cold outside environment. In this case, no sorption medium is required to adsorb the operating steam and consequently no regeneration of the sorption medium is required. In the preferred embodiment, it is advantageous to utilize both the cold face and the sorption medium container. This is advantageous when the sorption medium container is subjected to lower temperatures, at least for a period of time. Moreover, when using a cold face, it must be assured that non-condensable gases can be removed from the system through an evacuation device.

Further examples of applications for a cold face are on airplanes which fly through a very cold environment (i.e., at high altitudes). The temperatures at high altitudes may fall to −50° C. Transport containers for food and drinks, so called trolleys (food carts) or even total freight space areas, may be cooled with the use of cold faces during the flight. The operating steam flowing out of the evaporators of the trolleys may be condensed or freeze on the cold faces. On the ground and during the initial startup phase, the sorption filler absorbs the operating steam instead of condensing on the cold face. It is also advantageous if the air conditioning of the total airplane cabin is performed by the inventive cooling system. The alternating regeneration of two sorption medium fillers is then performed by hot exhaust gases from the turbine or through "bleed air" which is available on board at over 200° C. The operating steam manifold could be built and integrated into the systems of the plane, and corresponding connecting location coils could be coupled with air heat exchangers, ice makers and trolleys.

A further application of the present invention includes hotels and restaurants. For example, the customary mini bar refrigerator may be replaced by simple evaporator refrigerators which are connected to an operating steam manifold, having one or a plurality of connecting locations in each hotel room. At a central location, the operating steam manifold line discharges into one or a plurality of sorption medium containers which are alternately regenerated by waste heat from any one of a variety of sources. Naturally, the subject invention may also be used in private homes, where refrigerators and air conditioning evaporators are installable in one or all of the rooms of the house.

What is possible in the hotel and household is also possible in vehicles. In passenger motor vehicles, in trucks and campers, a comfortable cooling system may be installed with a plurality of connecting locations coupled to an operating steam manifold line which meets all required cooling tasks. It is particularly advantageous for the air conditioning (cooling) of vehicles to permanently install the vacuum pump and operating medium manifold line in the vehicle, while the sorption medium container together with the evaporator is installed only when needed (i.e., in hot weather). In this manner, however, an air conditioning unit can cool the vehicle for a specific time period, which may depend on the sorption medium capacity. Naturally, longer cooling periods are possible without regeneration if a plurality of spare sorption medium containers are carried as back-ups.

A further exemplified case of application is the air conditioning of railroad compartments. Through a single operating steam manifold line, each car compartment may be air conditioned by means of an evaporator which operates as a heat exchanger. Here too, by providing additional connection locations, refrigerator type devices brought by passengers and having a corresponding evaporator may be connected to the manifold. Also, the possibility of passengers making ice directly is present. Furthermore, novel applications exist wherein a train restaurant can utilize the system in accordance with the present invention. For example, a self-service system may be constructed, wherein a liquid selected by a passenger is cooled when the liquid is drawn or passes through an evaporator in accordance with the invention. Therefore, the need to store precooled drinks is eliminated. Advantageously, each car of the train is equipped with its own sorption medium container and an associated vacuum pump so as to increase system capacity. In addition, a connecting line between the individual cars is thereby eliminated.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

We claim:

1. A vacuum tight manifold comprising:

a) a conduit having a plurality of connection locations, each of said plurality of connection locations being in fluid communication with one another, each of said plurality of connection locations provided with means for fluidly connecting one of an operating medium evaporator and a sorption medium container in a vacuum tight manner thereto, each of said plurality of connection locations is provided with means to seal off said connection location in a vacuum tight manner when one of the operating medium evaporator, having operating medium therein, and sorption medium container having sorption medium therein, is not coupled thereto, said operating medium providing operating medium vapor;

b) a vacuum pump coupled to the sorption medium container, the vacuum pump generating a vacuum pressure to facilitate the production of the operating medium vapor and the adsorption of operating medium vapor by the sorption medium; and c) a check valve providing fluid communication between the vacuum pump and the sorption medium container, the check valve permitting said vacuum pump to remove air and noncondensible gases from said cooling system during operation, the check valve preventing a flow of air and noncondensible gases into said cooling system.

2. A vacuum tight manifold as defined by claim 1, the check valve being coupled to one of the plurality of connection locations that has the operating medium evaporator coupled thereto, the check valve permitting a flow of operating medium vapor from the operating medium evaporator to the conduit, the check valve preventing a flow of operating medium vapor from the conduit to the operating medium evaporator.

3. A vacuum tight manifold as defined by claim 1, wherein said vacuum pump is an ejector pump driven by compressed air.

4. A vacuum tight manifold as defined by claim 1, further comprising a ball valve coupled to at least one of the plurality of connection locations, the ball valve being in fluid communication with the at least one of the plurality of connection locations.

5. A vacuum tight manifold as defined by claim 1, further comprising a flanged plain sealing surface coupled to at least one of the plurality of connection locations, the flanged plain sealing surface permitting the air-tight coupling of a container to the flanged plain sealing surface, the flanged plain sealing surface permitting fluid communication of the container with the at least one of the plurality of connection locations.

6. A vacuum tight manifold as defined by claim 1, further comprising air cooling means coupled to at least one of the plurality of connection locations, the air cooling means being in fluid communication with the at least one of the plurality of connection locations to provide a supply of cool air to a remote locations.

7. A vacuum tight manifold as defined by claim 1, further comprising a blind plug coupled to at least one of the plurality of connection locations, the blind plug providing an air tight closure of the at least one of the plurality of connection locations.

8. A vacuum tight manifold as defined by claim 1, further comprising a two-sided closing coupler in fluid communication with at least one of the plurality of connection locations, the two-sided closing coupler providing rapid coupling of a device of the vacuum tight manifold.

9. A vacuum tight manifold as defined by claim 1, further comprising a food refrigeration system coupled to at least one of the plurality of connection locations.

10. A vacuum tight manifold as defined by claim 1, further comprising a liquid cooling system couple to at least one of the plurality of connection locations.

* * * * *